US006483996B2

(12) United States Patent
Phillips

(10) Patent No.: US 6,483,996 B2
(45) **Date of Patent: *Nov. 19, 2002**

(54) METHOD AND SYSTEM FOR PREDICTING PRINT QUALITY DEGRADATION IN AN IMAGE FORMING DEVICE

(75) Inventor: Quintin T. Phillips, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/824,891

(22) Filed: Apr. 2, 2001

(65) Prior Publication Data

US 2002/0141769 A1 Oct. 3, 2002

(51) Int. Cl.[7] ..... G03G 15/00; G03G 15/02; G03G 15/043

(52) U.S. Cl. ..... 399/38; 399/44; 399/49; 399/50; 399/51

(58) Field of Search ..... 399/9, 27, 38, 399/44, 48, 49, 50, 51

(56) References Cited

U.S. PATENT DOCUMENTS 4,026,643 A 5/1977 Bergman ..... 355/3
5,250,988 A 10/1993 Matsuura et al. ..... 355/208
5,272,503 A 12/1993 LeSueur et al. ..... 355/208
5,416,563 A * 5/1995 Magde ..... 399/27
5,461,462 A 10/1995 Nakane et al.
5,523,831 A * 6/1996 Rushing ..... 399/50 X
5,621,497 A 4/1997 Terasawa et al. ..... 355/53
5,623,714 A * 4/1997 Thompson et al. ..... 399/51
5,999,761 A 12/1999 Binder et al. ..... 399/49
6,006,047 A * 12/1999 Mara et al. ..... 399/49
6,304,278 B1 10/2001 Coleman
2002/0021321 A1 2/2002 Nakajima et al.

* cited by examiner

*Primary Examiner*—Fred L Braun

(57) ABSTRACT

Method and system for predicting print quality degradation in an image forming device. Correction factors produced during calibration cycles are stored for future analysis. The correction factors, or alternatively new printer control parameters which incorporate the correction factors, may be adjusted for current environmental conditions. During the calibration cycle, the correction factors produced during the current calibration cycle and old correction factors produced during prior calibration cycles are analyzed to determine if the printer control parameters are within desired degradation limits, which indicate that the print quality of the imaging forming device will degrade beyond acceptable limits prior to the next calibration cycle. Thus, a statistical analysis of the historical data produced during calibration cycles can be used to predict when the image quality of the image printing device will degrade beyond acceptable limits.

16 Claims, 2 Drawing Sheets

METHOD AND SYSTEM FOR PREDICTING PRINT QUALITY DEGRADATION IN AN IMAGE FORMING DEVICE

FIELD OF THE INVENTION

The present invention relates to an image forming apparatus, such as printers, and more particularly to systems for monitoring and analyzing the calibration routines of the image forming device to predict print quality degradation.

BACKGROUND

Many image forming devices, e.g., copiers, printers, plotters, etc., include a controlling microprocessor which stores calibration data that enable adjustment of internal components in such a manner as to assure high quality document production. The calibration data is generally configured in the form of control parameters which are stored in either a random access memory or read-only memory, as the case may be. Control parameters can be stored directly on memory chips that are resident on replaceable consumable devices utilized with such devices.

In laser based printers, the electrophotographic process relies on control of toner particles and charge states. These fundamental materials and forces are influenced by a variety of external and internal conditions experienced in the printing process. For example, humidity, temperature, contaminants found on the surface of the photoreceptor, conditioning of the photoreceptor by previously printed patterns, manufacturing variations all affect the quality of printed image.

Electrophotographic printers include components that may be periodically tested and adjusted for changes in environment and/or operating conditions. For example, traditionally, toner cartridges have had life defined in terms of a toner load. The toner cartridge was considered good as long as there was toner available for printing. The advent of very large toner cartridges, e.g., with greater than 10,000 page capacity, has been accompanied by a new phenomena referred to as photoconductive (PC) drum wear out. With the use of a very large toner cartridge, the PC drum may wear out before the toner is expended. PC drum wear out occurs when low coverage or single page jobs are being printed and is caused by the number of rotations experienced by the PC drum. Newer technologies track the PC drum rotation and have established PC drum wear out limits that signal the end of the useful life of the toner cartridge.

Another new phenomena caused by the increased toner cartridge size is known as toner wear out. Toner wear out may occur when the toner in a toner cartridge is excessively stirred, which can be the result of low coverage, single page job printing or, in color printing, when one color is used very little but is rotated, e.g., in a carousel developer system. Toner wear out is different from PC drum wear out as it is not strictly a function of rotations, but is also a function of printed coverage. Toner wear out occurs when the materials designed to control flow and charge are displaced from the toner particle surface due to mechanical impact with container walls, handling components, or other toner particles. Removal of these materials cause the toner to charge or flow differently resulting in print quality defects.

Conventionally, image forming devices perform a calibration cycle to directly measure and adjust the control parameters for current changes in the environment and operating conditions, e.g., component wear out. A calibration cycle adjusts the control parameters of the image forming device only for present conditions and, thus, the calibration cycles will compensate for component wear out until failure actually occurs. Consequently, the calibration cycle will improve current image quality, but cannot predict when failure will occur, which may affect, e.g., a large print job.

Accordingly, what is needed is an apparatus and method of predicting when the print quality of the image forming device will degrade beyond acceptable limits, e.g., when system components will be worn out or exceed levels for which the device can compensate.

SUMMARY

An image forming device, in accordance with the present invention, stores the correction factors produced during calibration cycles for future analysis. The correction factors, or alternatively, the new printer control parameters, which incorporate the correction factors, are normalized for current environmental conditions. During a calibration cycle, the normalized correction factors produced during the current calibration cycle and old normalized correction factors produced during prior calibration cycles are analyzed to determine if the printer control parameters are within desired degradation limits. Thus, a statistical analysis of the normalized historical data produced during calibration cycles can be used to predict when the image quality of the image printing device will degrade beyond acceptable limits. A system for enabling prediction of image degradation of an image forming apparatus, thus includes a means for calibrating the image forming device, which results in at least one correction factor, a memory for storing data, and a processor. In one embodiment, the system includes an environmental condition measuring device that is used to adjust the correction factors generated during the calibration cycle for environmental conditions. The processor analyzes the correction factors from the current calibration cycle, which may be adjusted for environmental conditions, as well as from previous calibration cycles to determine if the control parameters are operating within statistical acceptable control limits, which indicate, for example, that the print quality of the imaging forming device will degrade beyond acceptable limits prior to the next calibration cycle.

In accordance with another aspect of the present invention, a method for detecting print quality degradation in an image forming device includes performing multiple calibration cycles and analyzing the historical data obtained in the calibration cycles. The calibration cycles include generating at least one correction factor that is used to adjust at least one control parameter used to operate the image forming device. The present environmental conditions may be measured and used to adjust the correction factor produced in the present calibration cycle. The correction factor is stored so that it may be analyzed during future calibration cycles. The correction factor of the current calibration cycle and the correction factors of previous calibration cycles are analyzed to determine if the control parameters are within statistical acceptable control limits. If the analysis indicates that the control parameter is outside desired limits, a warning is provided to the user.

DETAILED DESCRIPTION

While the invention will hereafter be described in the context of a laser printer, it is to be understood that the invention is equally applicable to other image forming devices such as inkjet printers, plotters, copying mechanisms, etc. Accordingly, the invention is to be considered in the broad context of image forming devices.

An image forming device, in accordance with the present invention, includes a calibration cycle that generally uses test patterns that are measured to provide feedback permitting compensation for the degradation of components and/or changes in environmental conditions. The test patterns, e.g., may be printed onto media or may be printed onto the photoconductive drum. The calibration data is recorded and analyzed to predict when the calibration cycle will fail, i.e., wear of the system components and/or environmental conditions may prevent the system from providing acceptable print quality. A calibration cycle that may be used in accordance with the present invention is described in detail in U.S. Pat. No. 5,999,761, entitled "Dynamic Adjustment of Characteristics of an Image Forming Apparatus," issued Dec. 7, 1999, to Binder et al., which is incorporated herein by reference.

Figure 1:
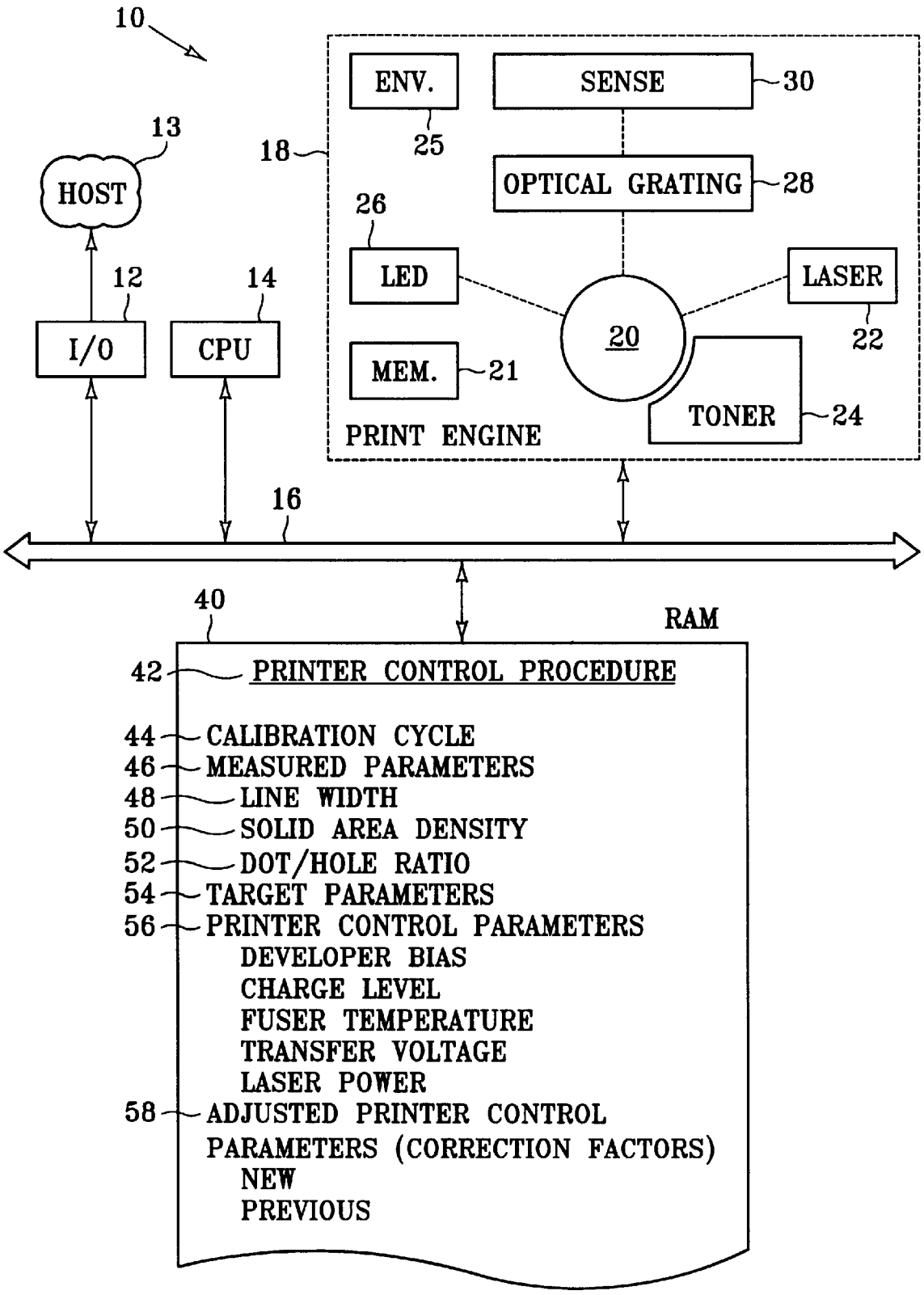
FIG. 1 is a high level block diagram of an image forming apparatus in accordance with the invention.

FIG. 1 is a block diagram of an image forming device, in the form of a laser printer 10 that includes an input/output module 12 for receiving image data from a host processor 13. A central processing unit (CPU) 14 is coupled to a bus system 16 (along with I/O module 12) to enable communications with other elements of printer 10. A print engine 18 includes a removable photoconductive drum (photoreceptor 20) that includes an integral memory chip 21 mounted therewith. Print engine 18 further includes a laser 22 whose output is scanned across the surface of photoreceptor 20 in the known manner to create an image thereon. One or more toner modules 24 are utilized to apply toner particles to the charged image on photoreceptor 20. Thereafter, the toned image is transferred to a media sheet which, in turn, is carried out of printer 10 by a media transport mechanism (not shown). In one embodiment, an environmental measuring device 25 is included in print engine 18 or other appropriate location. The environmental measuring device 25, which are well known to those of ordinary skill in the art may be anywhere in the system, including, e.g., a circuit board, or may be a remote device.

Prior to the toned image being transferred to the media sheet, the toned image passes beneath a set of light emitting diodes 26 which illuminate the surface of the toned image as it passes beneath an optical grating 28 and an optical sensor 30.

As will be hereafter understood, a test pattern is periodically caused to be generated on photoreceptor 20 or for example, on an appropriate media, and the pattern is viewed by sensor 30 through optical grating 28 to achieve control signals in accordance with the sensed pattern on photoreceptor 20. The generation of interference patterns, resulting from the presence of grating 28, allows the electrophotographic process to be adjusted for optimum performance, through analysis of the interference patterns.

Interference patterns are useful for analyzing anomalies or small changes in generally uniform patterns. The interference pattern is generated by viewing the test pattern through a known uniform grid. By constructing optical grating 28 with sufficient resolution, it is possible to detect changes in the test pattern on photoreceptor 20 that are much smaller than the spacing of the test pattern lines. Thus, for instance, when a test pattern of lines is written by laser 22 on photoreceptor 20 and is then developed by application of toner particles, the test pattern is subsequently viewed by sensor 30 through optical grating 28. The rotation of photoreceptor 20 causes a pulsing of the optical signal generated by sensor 30 to occur at a uniform rate. Thus, changes in frequency and/or intensity of the pulsed optical signals can be precisely detected and related to changes in the system's ability to uniformly construct lines.

Accordingly, using the output from sensor 30, CPU 14 can calculate adjustments to control parameters to enable the creation of more precise linewidths. Such parameter adjustments may, e.g., control laser power, dot position, developer bias, and charge levels.

To enable operation of such an adaptive procedure, laser printer 10 includes a random access memory (RAM) 40 which includes a printer control procedure 42 which, in conjunction with CPU 14, controls the operation of laser printer 10. Printer control procedure 42 includes a calibration cycle 44, which periodically causes a test pattern to be produced on photoreceptor 20 or other appropriate media. That test pattern is later analyzed by comparison of the parameter values derived from outputs from sensor 30 to stored parameter values that would be expected to be produced by a test pattern of a quality which matches desired print characteristics.

Calibration cycle 44 receives input signals from sensor 30 that are indicative of interference patterns produced by optical grating 28. Those input signals enable generation of a set of measured parameters 46 which are indicative of image characteristics of the test pattern, e.g., linewidth 48, solid area density 50, dot/white ratio 52, etc. Those measured parameters are then compared to a stored set of target parameters 54 and correction factors in the form of the difference between the measured and target parameters are derived. Based on the correction factors, calibration cycle 44 produces new printer control parameters 56 that are stored in RAM 40 (or elsewhere). The correction factors may be used to adjust different printer control parameters 56 including one or more of the following: developer bias, photoreceptor charge level, fuser temperature, transfer voltage, laser power.

Conventionally, the new printer control parameters 56 are discarded after the printer is appropriately adjusted. Thus, in a subsequent calibration cycle, only new measurements of the test pattern are used to determine wear of components and to produce new printer control parameters 56.

In accordance with the present invention, however, the printer control parameters 56 are not discarded but are stored in RAM 40 or, e.g., memory 21, to be analyzed in later calibration cycles. Thus, the stored printer control parameters 58 include not only the new parameters determined in the current calibration cycle 44, but also include previous parameters determined during prior calibration cycles. It should be understood that the stored printer control parameters 58 inherently include the determined correction factors, and that if desired, only the correction factors from each calibration cycle 44 may be stored instead of the printer control parameters.

In one embodiment, the printer control parameters 56 are adjusted for current environmental conditions as determined by environmental measuring device 25 before being stored, e.g., in RAM 40. Thus, the stored printer control parameters (or correction factors) 58 include the printer control parameters from the current calibration cycle 44 as adjusted for environmental conditions, as well as printer control parameters from prior calibration cycles 44 as adjusted for the environmental conditions present at the time of those calibration cycles.

The stored data is analyzed in subsequent calibration cycles 44 in an ongoing manner. An appropriate statistical routine, e.g., CumSum, which is well known in the art, is used to analyze the stored data, i.e., the adjusted printer control parameters 58, to determine trends or extreme values in the printer control parameters. Through the analysis of the data from the present and previous calibration cycles 44, the point of failure of the calibration routine may be predicted, indicating when the system may no longer be able to provide acceptable print quality. If the analysis results in data indicating a significant wear of a component the user is warned and prompted to change the component to protect the print quality of the printed output. By adjusting the printer control parameters for environmental conditions, the analysis of the data from previous calibration cycles 44 and the current calibration cycle will be more accurate, i.e., the analysis will control for changes caused by environment rather than system degradation.

Thus, for example, the optical density of a printed output is determined by a calibration routine that sets, among other parameters, the development bias of the printing system. The interaction of the level of charge on the toner and the development bias results in the amount of toner being applied to the image. If the toner's ability to reach a given level of charge is gradually reduced, e.g., through wear, the printer compensates for the increased density by changing the development bias. Conventional printing systems allow the development bias to drift until failure occurs. Unfortunately, failure of a calibration cycle can disrupt the printing of a long job. Further, failure of the printer to properly inform the user of the cause of the calibration failure can result in a service call.

In accordance with an embodiment of the present invention, the correction factors applied to correct the development bias are monitored over multiple calibration cycles, corrected for environmental conditions (in one embodiment) and analyzed to predict when the system will fail. By tracking the calibration data and using the data to predict calibration failures, the user can proactively replace the toner cartridge before the failure negatively impacts a printed output.

After the replacement of a worn component, the stored printer control parameters (correction factors) 58 may continue to be stored to be used as a comparison to the stored printer control parameters (correction factors) 58 for the new component. Thus, the stored printer control parameters (correction factors) 58 for components that have been replaced may continue to be stored and used to adjust predictions of when the system component will wear out.

In another embodiment, after the replacement of a worn component, the stored printer control parameters (correction factors) 58 relative to that component may be discarded. Thus, for example, when the toner cartridge is replaced, the stored printer control parameters for the developer bias may be discarded, but the control parameters for the laser power may be retained. Consequently, the analysis of historical calibration data is based on data that accurately reflects the condition of the components currently present in the printing system.

Figure 2:
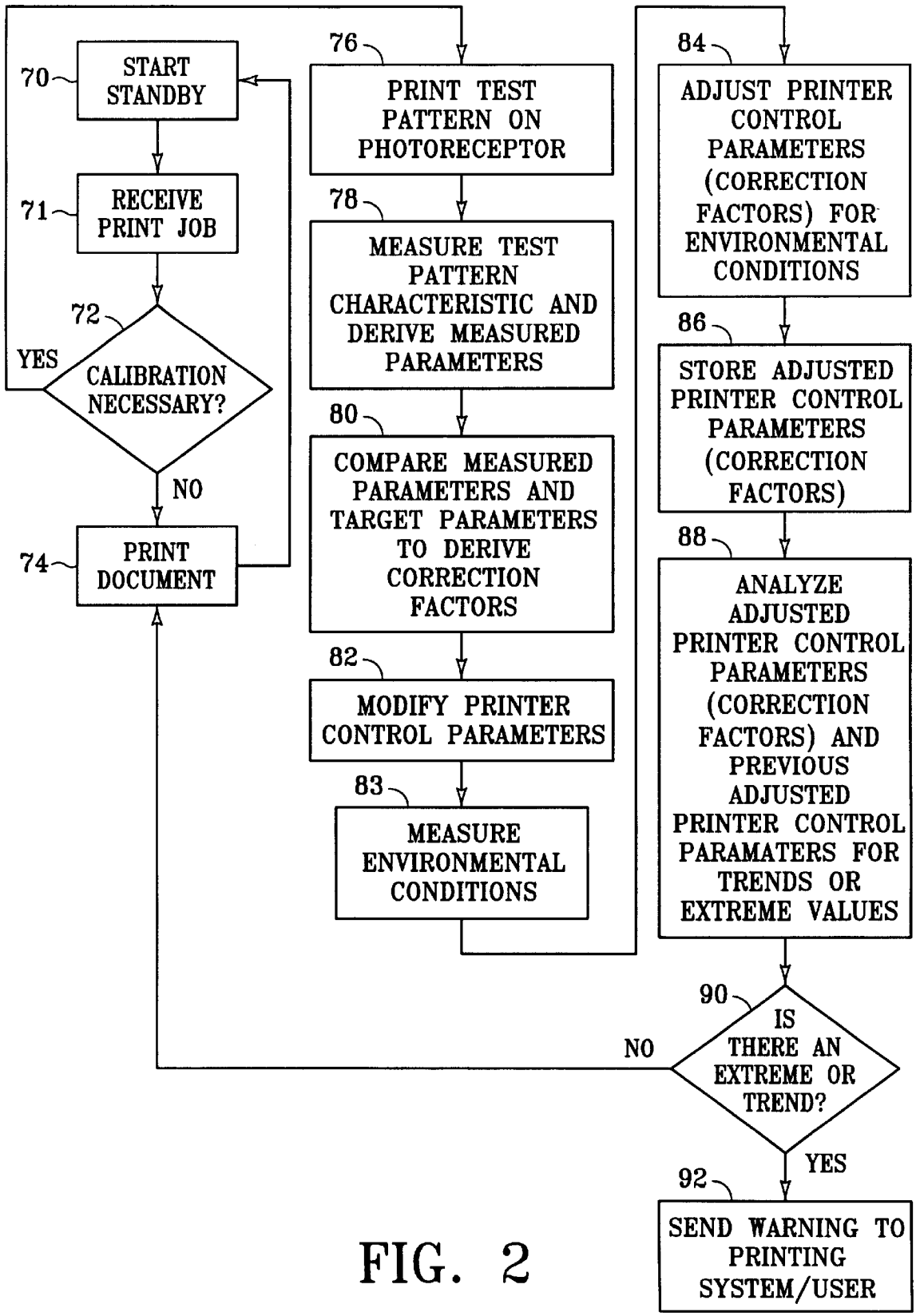
FIG. 2 is a high level flow diagram illustrating the method of the invention.

FIG. 2 is a flow chart illustrating the operation of a printing system including calibration cycle 44. As shown in FIG. 2, the operation of a print system in accordance with an embodiment of the present invention starts in standby (step 70). A print job is received (step 71) and a determination of whether a calibration routine is necessary is performed (step 72). If the calibration routine is not necessary, the document is printed (step 74) and the operation of print system returns to the start step, i.e., standby, in step 70.

If the calibration routine is necessary, the calibration cycle 44 (FIG. 1) is initiated by printer control procedure 42 and a test pattern is printed, e.g., on photoreceptor 20 (step 76) or other appropriate media. Thereafter, the toned test pattern on photoreceptor 20 is sensed by sensor 30, through optical grating 28, and the outputs from sensor 30 used to derive the measured parameters 46 of the test pattern (step 78). Thereafter, the measured test pattern parameters 46 are compared against target parameters 54 to determine the correction factors in the form of differences therebetween (step 80).

Once the correction factors have been determined, calibration cycle 44 controls CPU 14 to modify one or more control parameters 56 so as to alter the print conditions in a manner to bring subsequently measured test pattern parameters towards target parameters 54 (step 82).

In one embodiment, the environmental conditions are measured (step 83), using e.g., sensor 25, and the printer control parameters (correction factors) are adjusted to compensate for the current environmental conditions (step 84). However, in an embodiment where the printer control parameters (correction factors) are not adjusted for current environmental conditions, steps 83 and 84 is not necessary. The printer control parameters (correction factors) generated in the calibration cycle are stored, e.g., in RAM 44, along with previous printer control parameters (correction factors) from prior calibration cycles (step 86).

The adjusted printer control parameters (correction factors) and previous adjusted printer control parameters (correction factors) are analyzed, e.g., using CumSum or some other appropriate statistical routine, for trends or extremes (step 88). A decision is then made (step 90) based on the outcome of the statistical analysis of step 88 to print (step 74) and return to the start (step 70) if the trends or extreme values are within statistical acceptable control limits, or to send a warning to the system and/or user of a potential failure (step 92) if there is a trend or extreme outside the statistical acceptable control limits, indicating, e.g., that the performance of the system will degrade beyond acceptable limits prior to the next calibration cycle. For example, a warning may be produced if the value of the control parameter or correction factor exceeds a desired value, e.g., present by the designer, or if the rate of change of the printer control parameters or correction factors is too dramatic, e.g., exceeds twice the rate of change between previous calibration cycles.

It should be understood that the foregoing description is only illustrative of the invention. Various alternatives and modifications can be devised by those skilled in the art without departing from the invention. For instance, while the invention has been described assuming that the test pattern is sensed directly from the photoreceptor, the test pattern can also be sensed after transfer to a transfer system or a media sheet, with a reorientation of the optical illumination/sensing apparatus within the printer. Moreover, if desired, the unadjusted printer control parameters may be stored along with the corresponding environmental conditions, so that the adjustment of the printer control parameters may be performed during the analysis. It should be understood that either printer control parameters or the correction factors may be stored and analyzed in accordance with the present invention. Further, the printer control parameters or correction factors need not be adjusted for environmental conditions. Accordingly, the present invention is intended to embrace all such alternatives, modifications and variances which fall within the scope of the appended claims.

What is claimed is:

1. A method for predicting print quality degradation in an image forming device, said method comprising:

performing a first calibration cycle;

performing a second calibration cycle, wherein each calibration cycle comprises:

generating at least one correction factor to modify at least one control parameter used to operate said image forming device to bring the image characteristics produced by said image forming device closer to desired image characteristics;

storing said correction factor; and analyzing said correction factor from said first calibration cycle and said correction factor from said second calibration cycle to determine if said correction factor is within desired limits.

2. The method of claim 1, wherein each calibration cycle further comprises:

measuring environmental conditions;

adjusting said correction factor for said environmental conditions prior to storing said correction factor.

3. The method of claim 1, wherein each calibration cycle comprises generating a plurality of correction factors to modify a plurality of control parameters, and storing said plurality of correction factors.

4. The method of claim 1, wherein said at least one control parameter includes:

developer bias, charge level, fuser temperature, transfer voltage, and laser power.

5. The method of claim 1, wherein generating correction factors comprises:

producing a test pattern image;

detecting image characteristics indicative of said test pattern image and producing measured signal data in accordance therewith; and comparing said measured signal data with stored target signal data indicative of desired image characteristics to produce said correction factors.

6. The method of claim 1 wherein said image forming device is a laser printer.

7. The method of claim 1, said method comprising performing a plurality of calibration cycles prior to performing said second calibration cycle, wherein correction factors from each of said plurality of calibration cycles is stored, and analyzing said correction factors from said plurality of calibration cycles and said correction factor from said second calibration cycle to determine if said control parameter is within desired limits.

8. The method of claim 7, wherein analyzing said correction factors from said plurality of calibration cycles and said correction factor from said second calibration cycle comprises analyzing said correction factors for at least one of trends and extremes.

9. The method of claim 1, further comprising providing an indication to a user if said correction factor is not within said desired limits.

10. The method of claim 1, wherein said desired limits are indicative of wear on system components for which said calibration cycle will not be able to compensate.

11. A system for enabling prediction of image degradation of an image forming apparatus, said system comprising:

calibration means for producing at least one correction factor to modify at least one control parameter used to operate said image forming device;

memory for storing correction factors from a plurality of calibration cycles; and processor means for analyzing said correction factor for a current calibration cycle and correction factors from previous calibration cycles to determine if said control parameters are within desired limits.

12. The system of claim 11, further comprising:

an environmental condition measuring device;

said memory stores correction factors adjusted for environmental conditions; and processor means for adjusting said correction factors for environmental conditions, wherein said correction factors from previous calibration cycles were adjusted for environmental conditions.

13. The system of claim 12, wherein said adjusting said correction factors comprises adjusting said modified control parameters.

14. The system of claim 11, wherein said image forming apparatus is a laser printer.

15. A method for detecting print quality degradation in an image forming device, said method comprising:

performing a plurality of calibration cycles, each calibration cycle comprising:

generating at least one correction factor to modify at least one control parameter used to operate said image forming device to bring the image characteristics produced by said image forming device closer to desired image characteristics;

measuring environmental conditions;

adjusting said correction factor for environmental conditions;

storing said adjusted correction factor; and analyzing said adjusted correction factor of a current calibration cycle and adjusted correction factors from previous calibration cycles to predict if system components of said image forming device will degrade beyond an acceptable level before the next calibration cycle.

16. The method of claim 15, wherein said method comprises adjusting said at least one control parameter, storing said at least one control parameter, and analyzing said adjusted at least one control parameter, wherein said correction factor is part of said at least one control parameter.

* * * * *